US010475561B2

(12) United States Patent
Sagawa et al.

(10) Patent No.: US 10,475,561 B2
(45) Date of Patent: Nov. 12, 2019

(54) RFEB SYSTEM MAGNET PRODUCTION METHOD, RFEB SYSTEM MAGNET, AND COATING MATERIAL FOR GRAIN BOUNDARY DIFFUSION TREATMENT

(71) Applicants: INTERMETALLICS CO., LTD., Nakatsugawa-shi, Gifu (JP); DAIDO STEEL CO., LTD., Nagoya-shi, Aichi (JP)

(72) Inventors: Masato Sagawa, Kyoto (JP); Shinobu Takagi, Niwa-gun (JP); Hayato Hashino, Yatomi (JP)

(73) Assignees: INTERMETALLICS CO., LTD., Nakatsugawa (JP); DAIDO STEEL CO., LTD., Nagoya (JP)

( * ) Notice: Subject to any disclaimer, the term of this patent is extended or adjusted under 35 U.S.C. 154(b) by 909 days.

(21) Appl. No.: 14/777,638

(22) PCT Filed: Mar. 13, 2014

(86) PCT No.: PCT/JP2014/056702
§ 371 (c)(1),
(2) Date: Sep. 16, 2015

(87) PCT Pub. No.: WO2014/148353
PCT Pub. Date: Sep. 25, 2014

(65) Prior Publication Data

US 2016/0300649 A1 Oct. 13, 2016

(30) Foreign Application Priority Data

Mar. 18, 2013 (JP) ..... 2013-055737

(51) Int. Cl.
*H01F 1/057* (2006.01)
*B22F 1/02* (2006.01)
(Continued)

(52) U.S. Cl.
CPC ..... *H01F 1/0571* (2013.01); *B22F 1/02* (2013.01); *H01F 41/0253* (2013.01); *B22F 3/14* (2013.01);
(Continued)

(58) Field of Classification Search
None
See application file for complete search history.

(56) References Cited

U.S. PATENT DOCUMENTS

2006/0213583 A1 9/2006 Nakamura et al.
2006/0213584 A1* 9/2006 Nakamura ..... C22C 38/005 148/302
(Continued)

FOREIGN PATENT DOCUMENTS

BR PI0600210 A 11/2006
CN 1838342 A 9/2006
(Continued)

OTHER PUBLICATIONS

Jun. 20, 2017 Office Action issued in Chinese Patent Application No. 201480016944.6.
(Continued)

*Primary Examiner* — Guinever S Gregorio
(74) *Attorney, Agent, or Firm* — Oliff PLC

(57) ABSTRACT

A method for producing an RFeB system magnet with high coercivity by preventing a coating material from peeling off the surface of a base material during a grain boundary diffusion treatment is provided. A method for producing an $R^L{}_2Fe_{14}B$ system magnet which is a sintered magnet or a hot-deformed magnet containing, as the main rare-earth element, a light rare-earth element $R^L$ which is at least one of the two elements of Nd and Pr, the method including: applying, to a surface of a base material M of the $R^L{}_2Fe_{14}B$ system magnet, a coating material prepared by mixing a
(Continued)

silicone grease and an $R^H$-containing powder containing a heavy rare-earth element $R^H$ composed of at least one element selected from the group of Dy, Tb and Ho; and heating the base material together with the coating material. Improved coating and base materials adhesion facilitates transfer of $R^H$ into base material grain boundaries.

9 Claims, 4 Drawing Sheets

(51) Int. Cl.
*H01F 41/02* (2006.01)
*B22F 3/14* (2006.01)
*C22C 28/00* (2006.01)

(52) U.S. Cl.
CPC ..... *C22C 28/00* (2013.01); *H01F 1/0576* (2013.01); *H01F 1/0577* (2013.01)

(56) References Cited

U.S. PATENT DOCUMENTS

| | | | | |
|---|---|---|---|---|
| 2009/0297699 | A1 | 12/2009 | Baba et al. | |
| 2013/0026870 | A1 | 1/2013 | Baba et al. | |
| 2014/0271323 | A1* | 9/2014 | Wang | H01F 41/0266 419/25 |
| 2015/0221423 | A1* | 8/2015 | Mizoguchi | C22C 38/002 75/246 |

FOREIGN PATENT DOCUMENTS

| | | | |
|---|---|---|---|
| CN | 100520992 | C | 7/2009 |
| CN | 101620904 | A | 1/2010 |
| CN | 101911227 | A | 12/2010 |
| CN | 102859621 | A | 1/2013 |
| CN | 103098151 | A | 5/2013 |
| CN | 104488048 | A | 4/2015 |
| DE | 10 2014 113 865 | A1 | 3/2015 |
| EP | 1643513 | A1 | 4/2006 |
| EP | 1705671 | A2 | 9/2006 |
| EP | 1970924 | A1 | 9/2008 |
| EP | 2267730 | A2 | 12/2010 |
| EP | 2555207 | A1 | 2/2013 |
| EP | 2565885 | A1 | 3/2013 |
| EP | 2772926 | A1 | 9/2014 |
| EP | 2879142 | A1 | 6/2015 |
| JP | H02-65103 | A | 3/1990 |
| JP | H11-329810 | A | 11/1999 |
| JP | 2006-019521 | A | 1/2006 |
| JP | 2006-303433 | A | 11/2006 |
| JP | 2006-303436 | A | 11/2006 |
| JP | 2007-250577 | A | 9/2007 |
| JP | 2007-258455 | A | 10/2007 |
| JP | 2009-289994 | A | 12/2009 |
| JP | 2009-302318 | A | 12/2009 |
| JP | 2010-114200 | A | 5/2010 |
| JP | 2011-051851 | A | 3/2011 |
| JP | 2011-233663 | A | 11/2011 |
| KR | 2006-0102480 | A | 9/2006 |
| MY | 142088 | A | 9/2010 |
| RU | 2006103684 | A | 8/2007 |
| RU | 2377680 | C2 | 12/2009 |
| WO | 2011/122667 | A1 | 10/2011 |
| WO | 2011/136223 | A1 | 11/2011 |

OTHER PUBLICATIONS

Jun. 24, 2014 Written Opinion issued in International Patent Application No. PCT/JP2014/056702.
Jun. 24, 2014 International Search Report issued in International Patent Application No. PCT/JP2014/056702.
Jan. 10, 2017 Office Action issued in Japanese Patent Application No. 2015-506727.
Mar. 22, 2017 Office Action issued in European Patent Application No. 14768462.5.
Jul. 24, 2018 Office Action issued in Japanese Patent Application No. 2017-139055.
Feb. 19, 2016 Search Report issued in European Patent Application No. 14768462.5.
Oct. 6, 2016 Office Action issued in Korean Patent Application No. 10-2015-7027685.
Oct. 26, 2016 Office Action issued in Chinese Patent Application No. 201480016944.6.
Apr. 10, 2019 Office Action issued in Chinese Patent Application No. 2018-10001024.7.

* cited by examiner

RFEB SYSTEM MAGNET PRODUCTION METHOD, RFEB SYSTEM MAGNET, AND COATING MATERIAL FOR GRAIN BOUNDARY DIFFUSION TREATMENT

TECHNICAL FIELD

The present invention relates to a method for producing an RFeB system magnet with the main phase made of $R_2Fe_{14}B$ (where R represents a rare-earth element). In particular, it relates to a method for diffusing at least one rare-earth element selected from the group of Dy, Tb and Ho (these three rare-earth elements are hereinafter collectively called the "heavy rare-earth elements $R^H$"), through the grain boundaries of the main phase grains of the RFeB system magnet, into regions near the surfaces of those main phase grains, where the main phase contains at least one of the two elements of Nd and Pr as the main rare-earth element (these two rare-earth elements are hereinafter collectively called the "light rare-earth elements $R^L$"). The present invention also relates to an RFeB system magnet produced by this method, as well as a coating material for grain boundary diffusion treatment to be used in the same method.

BACKGROUND ART

RFeB system magnets were discovered in 1982 by Sagawa (one of the present inventors) and other researchers. The magnets have the characteristic that most of their magnetic characteristics (e.g. residual magnetic flux density) are far better than those of other conventional permanent magnets. Therefore, RFeB system magnets are used in a variety of products, such as driving motors for hybrid or electric automobiles, battery-assisted bicycle motors, industrial motors, voice coil motors (used in hard disk drives or other apparatuses), high-grade speakers, headphones, and permanent magnetic resonance imaging systems.

Earlier versions of the RFeB system magnet had the defect that the coercivity $H_{cJ}$ was comparatively low among various magnetic properties. Later studies have revealed that a presence of a heavy rare-earth element $R^H$ within the RFeB system magnet makes reverse magnetic domains less likely to occur and thereby improves the coercivity. The reverse magnetic domain has the characteristic that, when a reverse magnetic field opposite to the direction of magnetization is applied to the RFeB system magnet, it initially occurs in a region near the boundary of a grain and subsequently develops into the inside of the grain as well as to the neighboring grains. Accordingly, it is necessary to prevent the initial occurrence of the reverse magnetic domain. To this end, $R^H$ only needs to be present in regions near the boundaries of the grains so that it can prevent the reverse magnetic domain from occurring in the regions near the boundaries of the grains. On the other hand, increasing the $R^H$ content unfavorably reduces the residual magnetic flux density $B_r$ and consequently decreases the maximum energy product $(BH)_{max}$. Increasing the $R^H$ content is also undesirable in that $R^H$ are rare elements and their production sites are unevenly distributed globally. Accordingly, in order to increase the coercivity (and thereby impede the formation of the reverse magnetic domain) while decreasing the $R^H$ content to the lowest possible level, it is preferable to make the $R^H$ exist at high concentrations in a region near the surface (grain boundary) of the grain rather than in deeper regions.

Patent Literatures 1 and 2 each disclose a method for diffusing $R^H$ atoms through the grain boundaries of an RFeB system magnet into regions near the surfaces of the grains by adhering a powder or other forms of material containing an $R^H$ or $R^H$ compound to the surface of the RFeB system magnet and heating the RFeB system magnet together with the adhered material. Such a method of diffusing $R^H$ atoms through the grain boundaries into regions near the grains is called the "grain boundary diffusion method." An RFeB system magnet before being subjected to the grain boundary diffusion treatment is hereinafter called the "base material" and is distinguished from an RFeB system magnet which has undergone the grain boundary diffusion treatment.

According to Patent Literature 1, a powder or foil containing an RH or $R^H$ compound is simply placed on the surface of the base material. Since the adhesion between the powder or foil and the base material is weak, it is impossible to diffuse a sufficient amount of $R^H$ atoms into the regions near the surfaces of the grains in the RFeB system magnet. On the other hand, according to Patent Literature 2, a coating material prepared by dispersing a powder of $R^H$ or $R^H$ compound in an organic solvent is applied to the surface of the base material. Such a coating material can yield a higher adhesion strength to the RFeB system magnet than the powder (singly used) or foil, so that a greater amount of $R^H$ atoms can be dispersed into the regions near the surfaces of the grains in the RFeB system magnet.

There are various methods for applying such a coating material to the base material. In a method described in Patent Literature 2, a coating material in the form of slurry prepared by dispersing a powder of $R^H$ or $R^H$ compound in an organic solvent is applied to the surface of the base material by the technique of screen printing. Specifically, a screen having a permeable area for allowing the coating material to pass through is brought into contact with the surface of the base material. After a coating material is poured onto the surface of the screen from the side opposite to the base material across the screen, a squeegee is slid across that surface of the screen to supply the coating material through the permeable area to the surface of the base material. Consequently, a pattern of the coating material having a shape corresponding to the permeable area is formed on the surface of the base material. It is also possible to simultaneously apply the coating material to a number of base materials by arranging those base materials and providing one screen with a number of permeable areas corresponding to those base materials.

Patent Literature 2 also discloses a method including the steps of applying a coating material to one face of a plate-shaped base material, reversing the base material, and applying the coating material to the opposite face of the base material. In the step of applying the coating material to the opposite face, the base material is placed on a tray consisting of a plate having a hole slightly smaller than the outer shape of the base material, in such a manner that the edge of its material-applied face is supported by the plate surrounding the hole, whereby the applied material is prevented from coming in contact with the tray at the position of the hole. Furthermore, in the heating process for the grain boundary diffusion treatment performed after the application of the coating material, a supporting device with a plurality of pointed projections is used. The base material is placed on these projections, with one of the two material-applied faces directed downward (and accordingly the other face directed upward), whereby the contact between the coating material on the lower face and the supporting device is minimized.

There are three major types of RFeB system magnets: (i) a sintered magnet, which is produced by sintering a raw-material alloy powder mainly composed of the main phase grains; (ii) a bonded magnet, which is produced by molding a raw-material alloy powder with a binder (made of a polymer, elastomer or similar organic material) into a solid shape; and (iii) a hot-deformed magnet, which is produced by performing a hot-deforming process on a raw-material alloy powder. Among these types, the grain boundary diffusion treatment can be performed on (i) the sintered magnet and (iii) the hot-deformed magnet, which do not contain any binder made of an organic material in the grain boundaries.

CITATION LIST

Patent Literature

Patent Literature 1: JP 2007-258455 A
Patent Literature 2: WO 2011/136223 A
Patent Literature 3: JP 2006-019521 A
Patent Literature 4: JP H11-329810 A

SUMMARY OF INVENTION

Technical Problem

Although the previously described coating material has a stronger adhesion strength to the surface of the base material than powder or foil, it may peel off the surface of the base material when it is heated to diffuse $R^H$ through the grain boundaries of the base material. In particular, the coating material on the surface of the base material directed downward in the heating process more easily peels off due to gravitation. Even if the peeling does not actually occur, the transfer of $R^H$ from the coating material to the grain boundaries in the base material will be more difficult, and the grain boundary diffusion treatment will be less effective for improving the coercivity.

The problem to be solved by the present invention is to provide a method for producing an RFeB system magnet (RFeB system sintered magnet or RFeB system hot-deformed magnet) which can improve the adhesion of a coating material for grain boundary diffusion treatment and thereby increase the coercivity. The present invention also provides an RFeB system magnet produced by this RFeB system magnet production method, as well as a coating material for grain boundary diffusion treatment to be used in the RFeB system magnet production method.

Solution to Problem

The RFeB system magnet production method according to the present invention developed for solving the previously described problem is a method for producing an $R^L{}_2Fe_{14}B$ system magnet which is a sintered magnet or a hot-deformed magnet containing, as the main rare-earth element, a light rare-earth element $R^L$ which is at least one of the two elements of Nd and Pr, the method including the steps of:

applying, to a surface of a base material of the $R^L{}_2Fe_{14}B$ system magnet, a coating material prepared by mixing a silicone grease and an $R^H$-containing powder containing a heavy rare-earth element $R^H$ composed of at least one element selected from the group of Dy, Tb and Ho; and heating the base material together with the coating material.

Silicone is a polymer expressed by the general formula $X_3SiO\text{-}(X_2SiO)_n\text{-}SiX_3$ (where X represents organic groups, which do not need to be the same kind), which has a main chain including Si and O atoms alternately bonded. The bond between the Si and O atoms in this main chain is generally called the "siloxane bond." In the present invention, a silicone grease mainly composed of silicone having such a siloxane bond is contained in the coating material to be applied to the surface of the base material, whereby the coating material is prevented from peeling off the surface of the base material in the heating process for diffusing $R^H$ through the grain boundaries of the base material. In particular, the peeling can be prevented even on the face of the base material which is directed downward during the heating process and which therefore has conventionally allowed the coating material to easily peel off due to gravitation. Furthermore, the coating material has higher adhesion to the base material than the conventional one and thereby allows easier transfer of $R^H$ to the grain boundaries of the base material. Consequently, the coercivity of the RFeB system magnet will be increased.

The present invention can be suitably applied in the case where a screen having a permeable area for allowing the coating material to pass through is brought into contact with the surface of the base material and the coating material is applied through the permeable area to the surface of the base material (i.e. if the technique of screen printing is used).

In the present invention, a dispersant for enhancing the dispersibility of the $R^H$-containing powder may be added to the coating material. This prevents the $R^H$-containing powder from aggregating in the coating material. Therefore, the $R^H$-containing powder can be evenly dispersed over the surface of the base material. In the case of using the technique of screen printing, the screen is prevented from being clogged by the $R^H$-containing powder.

As the dispersant, a lubricant which is added to an alloy powder of the raw material in the process of producing the RFeB system magnet to improve the filling density and degree of orientation of the alloy powder can be used without any change. An example of such a dispersant is one which contains fatty ester as the main component. Specifically, a dispersant containing at least one of the following compounds as the main component can be suitably used: methyl caprylate, methyl caprate, methyl laurate, methyl myristate, ethyl caprylate, ethyl caprate, ethyl laurate, or ethyl myristate.

In the present invention, a silicone oil having a lower viscosity than the silicone grease may be added to the coating material. This method is effective if a coating material made from only the $R^H$-containing powder and the silicon grease is too viscous, and particularly, if the coating material cannot easily pass through the screen in the technique of screen printing.

As the $R^H$-containing powder, a powder of an alloy of $R^H$, Ni and Al ($R^H$—Ni—Al alloy) should preferably be used. Ni and Al have the effect of lowering the melting point of an $R^L$-rich phase, i.e. the phase which exists in the grain boundaries of the base material and has a higher $R^L$ content than the main phase. Therefore, when a powder of $R^H$—Ni—Al alloy is used as the $R^H$-containing powder, $R^H$ can be easily diffused into the base material through the grain boundaries where the $R^L$-rich phase is in a molten state during the grain boundary diffusion treatment.

By the RFeB system magnet production method according to the present invention, an RFeB system magnet having a high level coercivity as follows can be obtained.

In the case where Tb is not contained in the base material but in the coating material, and Dy is not contained in the coating material while whether or not Dy is present in the base material is unspecified, the coercivity $H_{cJ}$ (in kOe) at room temperature (23° C.) satisfies the following relationship:

$$0<x_1\leq 0.7,\ 0\leq x_2,\ \text{and}$$

$$H_{cJ}\geq 15\times x_1+2\times x_2+14 \quad (1)$$

where $x_1$ and $x_2$ respectively represent the weight percentages of Tb and Dy contained in the RFeB system magnet after the grain boundary diffusion treatment.

There is no specific upper limit of $x_2$. However, using too much Dy increases the production cost. Therefore, $x_2$ should preferably be 5 (% by weight) or less.

In the case where Tb is contained in neither the base material nor the coating material, and Dy is contained in the coating material while whether or not Dy is present in the base material is unspecified, it is possible to obtain an RFeB system magnet whose coercivity (in kOe) at room temperature (23° C.) satisfies the following relationship:

when $0<x_2<0.7$ $$H_{cJ}\geq 8.6\times x_2+14 \quad (2)$$

and when $0.7<x_2$ $$H_{cJ}\geq 2\times x_2+18.6 \quad (3)$$

where $x_2$ represents the weight percentage of Dy contained in the RFeB system magnet after the grain boundary diffusion treatment.

Once again, $x_2$ should preferably be 5 (% by weight) or less, since using too much Dy increases the production cost.

A coating material for grain boundary diffusion treatment according to the present invention is characterized by being a mixture of a silicone grease and an $R^H$-containing powder containing a heavy rare-earth element $R^H$ composed of at least one element selected from the group of Dy, Tb and Ho. A dispersant and/or silicone oil may be added to this coating material for grain boundary diffusion treatment. As the RH-containing powder, a powder of an alloy of $R^H$, Ni and Al ($R^H$—Ni—Al alloy) should preferably be used.

Advantageous Effects of the Invention

According to the present invention, a silicone grease mainly composed of silicone having a siloxane bond is contained in the coating material, whereby the adhesion of the coating material to the base material is improved. Therefore, the coating material is prevented from peeling off the surface of the base material in the grain boundary diffusion treatment, and the coercivity of the RFeB system magnet is increased. Such an effect of preventing the peeling is particularly noticeable on the face of the base material which is directed downward during the heating process.

DESCRIPTION OF EMBODIMENTS

An embodiment of the RFeB system magnet production method, RFeB system magnet and coating material for grain boundary diffusion treatment according to the present invention is described using FIGS. 1A through 6.

Similarly to a method using the normal grain boundary diffusion treatment, a sintered or hot-deformed magnet which does not contain any binder made of an organic material can be used as the base material M in the present embodiment. In the case of using a sintered magnet, either of the pressing and press-less methods (which will be hereinafter described) can be used to produce the magnet. In the pressing method, an alloy powder of a raw material is compression-molded into a predetermined shape with a pressing machine during or after the orienting process in a magnetic field, and the obtained compact is sintered. In the press-less method, which has recently been invented by Sagawa (one of the present inventors), the alloy powder of the raw material placed in a mold having a predetermined shape is oriented in a magnetic field and subsequently sintered, without the press-molding operation (see Patent Literature 3). Compared to the pressing method, the press-less method can achieve higher levels of the coercivity while reducing the amount of decrease in the residual magnetic flux density and maximum energy product, since this method causes no disorder of the oriented alloy powder of the raw material due to the pressing. The hot-deformed magnet is a magnet produced by shaping an alloy powder of a raw material by hot pressing and subsequently aligning crystal orientation by hot extrusion (see Patent Literature 4).

As described earlier, the base material M is made of a material containing a light rare-earth element $R^L$ as the main rare-earth element. If it is important to minimize the used amount of the rare and expensive element $R^H$ or reduce the amount of decrease in the residual magnetic flux density and maximum energy product, a base material which does not contain $R^H$ should preferably be used, although the present invention allows the base material M to contain a heavy rare-earth element $R^H$. That is to say, a base material M containing $R^H$ can be used if increasing the coercivity is considered to be important.

Figure 1A:
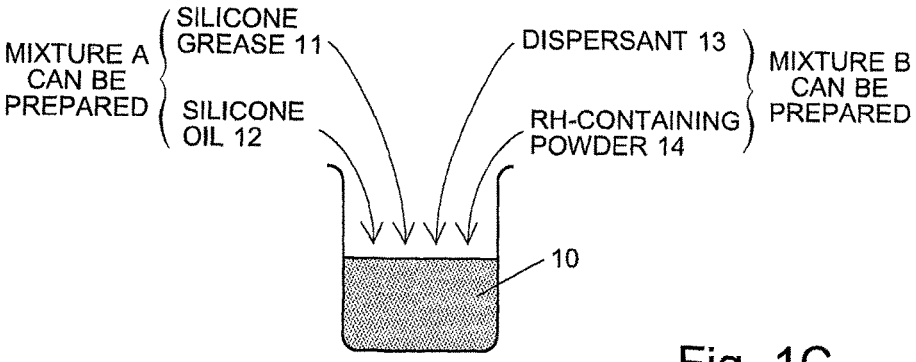
FIGS. 1A-1C are schematic diagrams showing one embodiment of the RFeB system magnet production method according to the present invention.

As shown in FIG. 1A, in the present embodiment, the coating material 10 for grain boundary diffusion treatment (which is hereinafter simply called the "coating material") is prepared by mixing a silicone grease 11, silicone oil 12, dispersant 13, and $R^H$-containing powder 14. These four materials may be simultaneously mixed, or they may be mixed in an arbitrary order. A preferable procedure is to initially prepare a mixture of the silicone grease 11 and the silicone oil 12 (which is called the "mixture A"), and subsequently mix this mixture A with the dispersant 13 and the $R^H$-containing powder 14. In this case, since the mixture A is less viscous than the silicone grease 11, the $R^H$-containing powder 14 can be more easily dispersed. It is also possible to initially prepare a mixture of the dispersant 13 and the $R^H$-containing powder 14 (which is called the "mixture B"), and subsequently mix this mixture B with the silicone grease 11 and the silicone oil 12. In this case, the dispersant 13 can sufficiently stick to the surfaces of the particles of the $R^H$-containing powder 14, facilitating the dispersion of the $R^H$-containing powder 14. Naturally, it is also possible to initially prepare both mixtures A and B, and subsequently mix the two mixtures A and B.

The kinds of silicone grease 11 and silicone oil 12 are not specifically limited; any commercial products can be used without any alteration. The dispersant 13 may also be any kind as long as it can improve the dispersibility of the $R^H$-containing powder. A preferable example is one which contains fatty ester, and particularly, one which contains either the methyl or ethyl group in its ester portion. Examples of such a dispersant include methyl caprylate, methyl caprate, methyl laurate and methyl myristate, as well as the compounds corresponding to those compounds with their methyl group replaced by the ethyl group (e.g. ethyl caprylate).

The lower the volatility of the dispersant 13 is, the more slowly it volatilizes from the coating material before being applied, so that it can more effectively suppress the aggregation of the $R^H$-containing powder which occurs with the elapse of time. Therefore, by using a less volatile dispersant 13, it is possible to continuously and efficiently perform the task of application to the base material M for a longer period of time without causing the clogging of the screen. Accordingly, if importance is attached to the efficiency of the applying task, methyl myristate is the most preferable among the aforementioned compounds (methyl caprylate, methyl caprate, methyl laurate and methyl myristate) since it has the lowest volatility. On the other hand, the higher the volatility of the dispersant 13 is, the more difficult it is for the carbon contained in the dispersant 13 to remain within the magnet after the grain boundary diffusion treatment, so that the amount of decrease in the coercivity due to the residual carbon can be more effectively reduced. Therefore, if importance is attached to an increase in the coercivity, it is preferable to use methyl caprylate since it has the highest volatility among the four aforementioned dispersants. If importance is attached to a balance between the efficiency of the applying task and the increase in the coercivity, it is preferable to use methyl laurate among the four aforementioned dispersants.

It should be noted that the silicone oil 12 and dispersant 13 are not indispensable for the present invention; a coating material which contains only one or none of them may also be used. If the coating material is applied to the base material by a screen-printing method as in the following example, a dispersant and/or silicone oil should preferably be added to prevent the clogging of the screen. However, if the coating material is directly applied to the surface of the base material without being passed through a screen, it is unnecessary to use those additives since the problem of clogging cannot occur.

The $R^H$-containing powder may be any kind of powder that contains $R^H$. $R^H$ may be contained in the form of a simple metal, in the form of an alloy of $R^H$ and other metallic elements, or in the form of a compound, such as a fluoride or oxide. It may also be a powder in which a particle that contains $R^H$ and a particle that does not contain $R^H$ are mixed.

Figure 1B:
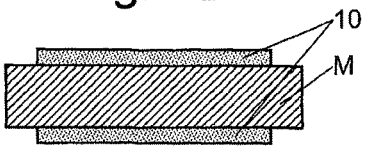

This coating material 10 is applied to the surface of the base material M (FIG. 1B).

Figure 2:
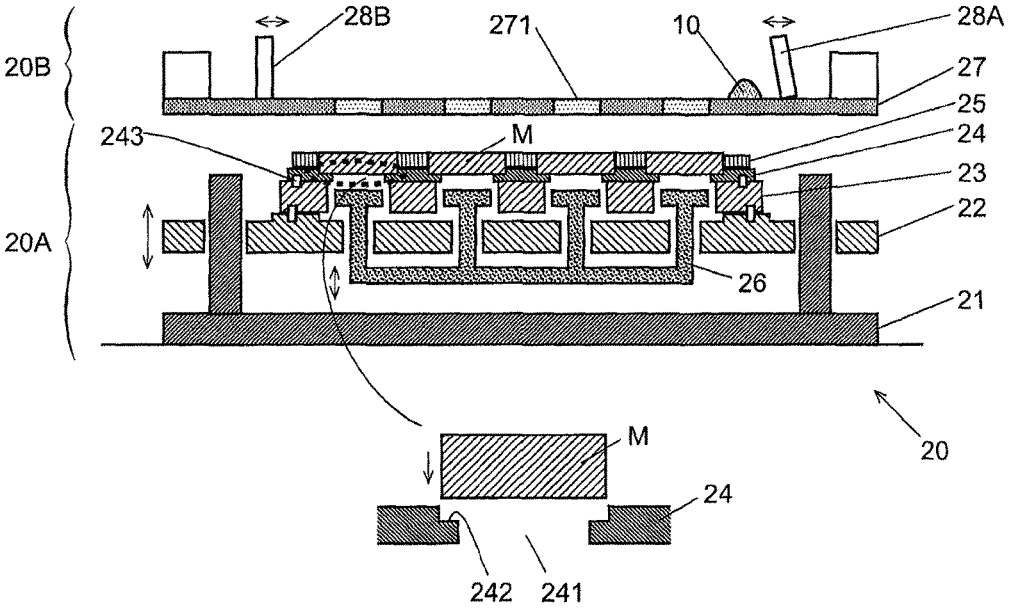
FIG. 2 is a view of an applicator used in the RFeB system magnet production method according to the present invention, with a partially enlarged view.

A screen-printing method as one method for applying the coating material to the base material M is hereinafter described using FIGS. 2 and 3. FIG. 2 shows one example of the applicator 20 for the screen-printing method. This applicator 20 is roughly composed of a work loader 20A and a print head 20B provided above the work loader 20A. The work loader 20A has a base 21, a lift 22 which can be vertically moved relative to the base 21, a frame 23 which can be placed on and removed from the lift 22, a tray 24 which can be placed on and removed from the frame 23, a supporter 25 provided on the upper side of the tray 24, and a vertically movable magnetic clamp 26. The print head 20B has a screen 27, as well as a squeegee 20A and a back scraper 28B which can be slid across the upper surface of the screen 27.

Figure 3:
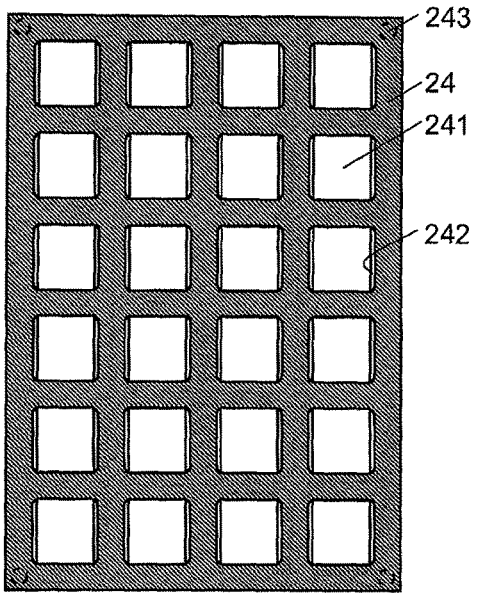
FIG. 3 is a top view of one example of the tray used in a screen-printing method.

As shown in FIG. 3, the tray 24 consists of a rectangular plate provided with a plurality of holes 241 for holding base materials M. A supporting portion 242 for supporting the base material M at its edges is formed on the lower side of each hole 241. The screen 27 is provided with the same number of permeable areas 271 as the holes 241 of the tray 24, for allowing the coating material 10 to pass through, at the positions corresponding to the holes 241. A screen made of polyester or stainless steel can be used as the screen 27.

The tray 24 has positioning pins 243 at the four corners on its lower side for fixing its position relative to the frame 23, while the frame 23 has holes at the positions corresponding to those pins 243. The horizontal positions of the screen 27, frame 23 and other elements except the tray 24 are previously fixed. Therefore, the positioning of the tray 24 relative to the frame 23 automatically makes the position of the holes 241 of the tray 24 coincide with that of the permeable areas 271 of the screen 27 in the earlier-mentioned way.

In the screen-printing method of the present embodiment, initially, a base material M is placed on the supporting portion 242 of the tray 24. Next, with the lift 22 in the lowered position, the tray 24 is placed on the frame 23. Subsequently, the supporter 25 is placed on the tray 24. Then, the lift 22 is moved upward to bring the upper face of the base material M on the tray 24 into contact with the permeable area 271 of the screen 27. Here, the supporter 25 serves to fill the level difference between the upper face of the base material M and that of the tray 24, and thereby prevents the screen 27 from damage. Subsequently, a coating material 10 is poured onto the upper surface of the screen 27, and the squeegee 28A being pressed onto the screen 27 is slid. Consequently, the coating material 10 is applied through the permeable area 271 of the screen 27 to the upper face of the base material M.

Subsequently, the lift 22 is lowered, and the base material M is removed from the tray 24 by pushing the base material M from below with the magnetic clamp 26 through the hole 241. Meanwhile, the coating material 10 remaining on the screen 27 is collected by the back scraper 28B to be reused in the next screen-printing process.

After the coating material is applied to one face of the base material M in the previously described manner, if the coating material also needs to be applied to the opposite face, the base material M is reversed by a system (not shown) and once more placed on the supporting portion 242. Then, the lift 22 is once more moved upward to bring the upper face of the base material M into contact with the permeable area 271, after which the squeegee 28A is slid across the upper surface of the screen 27.

The previous descriptions are concerned with the screen-printing method. As noted earlier, the coating material may be directly applied to the base material without being passed through the screen. A spraying or ink-jet method may also be used to apply the coating material to the base material.

Figure 1C:
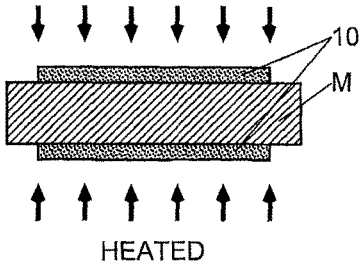

After the coating material is applied, the base material is heated to a predetermined temperature in a manner similar to the conventional grain boundary diffusion treatment to diffuse the $R^H$ atoms in the coating material through the grain boundaries of the base material into regions near the surfaces of the main phase grains (FIG. 1C). The heating temperature in this treatment is normally within the range of 800-950° C.

Hereinafter described are the results of experiments on the RFeB system magnet production method and the coating material for grain boundary diffusion treatment according to the present embodiment, as well as RFeB system magnets obtained in the experiments.

EXAMPLE

Initially, actually prepared examples of the coating material are described. In the present example, coating materials P1-P8 as shown in Table 1 were prepared. Methyl myristate or methyl laurate was used as the dispersant 13. The silicone grease 11 was used for all the coating materials P1-P8 in the present example, whereas the silicone oil 12 and dispersant 13 were not used for some of those coating materials. As the $R^H$-containing powder 14, a powder prepared by pulverizing an alloy of TbNiAl or DyNiAl containing Tb or Dy, Ni and Al at a weight ratio of 92:4.3:3.7 to an average particle size of 10 μm (in terms of the value determined by the laser diffraction particle size distribution measurement) was used. For convenience, the content ratios are expressed as follows: the total of the contents of the silicone grease 11, silicone oil 12 and $R^H$-containing powder 14 is expressed as 100% by weight, while the content of the dispersant 13 (which is much lower than those of the three aforementioned components) is expressed by its ratio to the total weight of those three components. Additionally, coating materials as comparative examples (CP1-CP4) were prepared using liquid paraffin in place of the silicone grease 11. Table 1 shows, for each of the coating materials P1-P8and CP1-CP4, the composition of the material, whether or not the material caused clogging of the screen, and whether nor not the amount of coating material applied to the surface of the base material was uneven.

TABLE 1

Prepared Coating Materials

| Coating Material | Components: $R^H$-Containing Powder RH | Solvent G | Solvent O | Dispersant L | Weight Ratio (RH:G:O:L) | Screen Clogged | Applied Amount Uneven |
|---|---|---|---|---|---|---|---|
| P1 | Powder A | Si-G | None | None | 80:20:0:0 | Yes | No |
| P2 | Powder A | Si-G | None | MM | 80:20:0:0.2 | Yes | No |
| P3 | Powder A | Si-G | Si-O | None | 80:10:10:0 | Yes | No |
| P4 | Powder A | Si-G | Si-O | MM | 80:10:10:0.01 | Yes | No |
| P5 | Powder A | Si-G | Si-O | MM | 80:10:10:0.1 | No | No |
| P6 | Powder A | Si-G | Si-O | MM | 80:10:10:0.2 | No | No |
| P7 | Powder A | Si-G | Si-O | LM | 80:10:10:0.2 | No | No |
| P8 | Powder B | Si-G | Si-O | LM | 80:10:10:0.2 | No | No |
| CP1 | Powder A | FP | None | None | 80:20:0:0 | No | Yes |
| CP2 | Powder B | FP | None | None | 80:20:0:0 | No | Yes |
| CP3 | Powder C | FP | None | None | 80:20:0:0 | No | Yes |
| CP4 | Powder D | FP | None | None | 80:20:0:0 | No | Yes |

Powder A = TbNiAl alloy (Tb: 92 wt %, Ni: 4.3 wt %, Al: 3.7 wt %)

Powder B = DyNiAl alloy (Dy: 92 wt %, Ni: 4.3 wt %, Al: 3.7 wt %)

Powder C = TbAlCoFeCuB alloy (Tb: 91 wt %, Al: 0.8 wt %, Co: 6.4 wt %, Fe: 2.0 wt %, Cu: 0.5 wt %, B: 0.1 wt %)

Powder D = DyAlCoFeNiCuB alloy (Tb: 91 wt %, Al: 0.8 wt %, Co: 2.8 wt %, Fe: 2.0 wt %, Cu: 0.5 wt %, Ni: 3.0 wt %, B: 0.1 wt %)

Note:

Due to the rounding, the total of the weight-percent values does not always be equal to 100 wt %.

Si-G = silicone grease,

FP = liquid paraffin,

Si-O = silicone oil

MM = methyl myristate,

LM = methyl laurate

The operation of applying each of these coating materials P1-P8 on a base material M by the screen-printing method was repeated. As a result, in the first operation, any of these coating materials could be applied to the base material M. However, after the operation was repeated several times, the coating materials P1-P4 caused clogging of the screen 27, whereas the coating materials P5-P8 did not cause clogging even after the operation was repeated 100 times. This difference is due to the fact that the coating materials P1-P4 contained little or no silicone oil 12 and/or dispersant 13 (one or more orders of magnitude lower than in the coating materials P5-P8). Accordingly, it is preferable to mix the silicone oil 12 and dispersant 13 in the coating material in order to prevent clogging of the screen 27 and thereby improve production efficiency. In the case of the comparative examples, the coating material cannot be prepared with uniform viscosity, so that the amount of applied material may become uneven.

In the present examples, base materials M1-M10 having the Dy content and magnetic properties (which were not measured for some of the base materials) as shown in Table 2 were used. A plurality of samples were created for each of the base materials M1-M10.

TABLE 2

Base Materials Used in Experiments

| Base Material No. | Tb Content (wt %) | Dy Content (wt %) | Magnetic Properties: Residual Magnetic Flux Density Br (kG) | Magnetic Properties: Coercivity HcJ (kOe) |
|---|---|---|---|---|
| M1 | 0.00 | 0.00 | 13.9 | 14.7 |
| M2 | 0.00 | 0.30 | 14.1 | 15.1 |
| M3 | 0.00 | 0.70 | 14.1 | 15.9 |
| M4 | 0.00 | 1.15 | 13.9 | 16.0 |
| M5 | 0.00 | 2.43 | 13.6 | 18.1 |
| M6 | 0.00 | 3.88 | 13.3 | 22.8 |
| M7 | 0.00 | 4.50 | 12.9 | 23.6 |
| M8 | 0.00 | 5.20 | 12.7 | 24.4 |
| M9 | 0.00 | 3.90 | 13.3 | 22.4 |
| M10 | 0.00 | 2.48 | — | — |

Hereinafter described are the results of experiments in which a grain boundary diffusion treatment was performed on the aforementioned base materials with the coating materials applied.

Experiment 1

A grain boundary diffusion treatment was performed by applying the coating material P7 to the base materials M1-M8 by a screen-printing method and heating them to 900° C. For the base materials M1 and M5, a plurality of samples containing different amounts of coating material P7, i.e. different amounts of Tb and Dy, were prepared. The contents of these elements in the applied coating material were not directly measured; instead, the contents in the sample after the grain boundary diffusion treatment were estimated (as will be described later). For comparison with the present example, a base material M5 with the coating material CP1 applied (Sample No. C1-1) and a base material M1 with the coating material CP2 applied (Sample No. C1-2) were prepared.

For each obtained sample, the residual magnetic flux density Br and coercivity were measured as magnetic properties. Furthermore, the Tb and Dy contents in each obtained sample were gravimetrically determined, with the residual coating material left on the sample surface (the columns labelled "Total" in Table 3 below). In the present experiment, the contents of Tb and Dy originating from the coating material (the columns labelled "From Coating Material" in Table 3) were calculated by subtracting the content of those elements in the base material from the content value obtained by the measurement. The contents of Tb and Dy originating from the coating material are the total of (i) the amount diffused within the base material (in the grain boundaries and the regions near the surfaces of the main phase grains) and (ii) the amount remaining on the surface of the sample without being diffused into the base material.

The manufacturing condition, magnetic properties, and the data of Tb and Dy contents of each sample are shown in Table 3. The numerical values in parentheses in the columns labelled "Magnetic Properties" in Table 3 (and in Tables 4-6 which will be presented later) show the magnetic properties of the base material used for each sample.

TABLE 3

Experimental Condition and Result of Experiment 1

| Sample | Coating Material | Base Material (Tb Not Contained): Material No. | Base Material (Tb Not Contained): Dy (wt %) | From Coating Material: Tb (wt %) | From Coating Material: Dy (wt %) | Total: Tb (wt %) | Total: Dy (wt %) | Magnetic Properties: Br (kG) | Magnetic Properties: HcJ (kOe) |
|---|---|---|---|---|---|---|---|---|---|
| E1-1 | P7 | M1 | 0.00 | 0.50 | 0.00 | 0.50 | 0.00 | 13.9 (13.9) | 25.3 (14.7) |
| E1-2 | P7 | M2 | 0.30 | 0.49 | 0.00 | 0.49 | 0.30 | 14.0 (14.1) | 25.1 (15.1) |
| E1-3 | P7 | M3 | 0.70 | 0.49 | 0.00 | 0.49 | 0.70 | 13.9 (14.1) | 26.1 (15.9) |
| E1-4 | P7 | M4 | 1.15 | 0.49 | 0.00 | 0.49 | 1.15 | 13.5 (13.9) | 27.8 (16.0) |
| E1-5 | P7 | M5 | 2.43 | 0.50 | 0.00 | 0.50 | 2.43 | 13.4 (13.6) | 29.3 (18.1) |
| E1-6 | P7 | M5 | 2.43 | 0.67 | 0.00 | 0.67 | 2.43 | 13.4 (13.6) | 29.7 (18.1) |
| E1-7 | P7 | M6 | 3.88 | 0.49 | 0.00 | 0.49 | 3.88 | 13.0 (13.3) | 32.4 (22.8) |
| E1-8 | P7 | M7 | 4.50 | 0.49 | 0.00 | 0.49 | 4.50 | 12.7 (12.9) | 33.1 (23.6) |
| E1-9 | P7 | M8 | 5.20 | 0.49 | 0.00 | 0.49 | 5.20 | 12.5 (12.7) | 35.0 (24.4) |

TABLE 3-continued

| Experimental Condition and Result of Experiment 1 | | | | | | | | | |
|---|---|---|---|---|---|---|---|---|---|
| | | Base Material (Tb Not Contained) | | From Coating Material | | Total | | Magnetic Properties | |
| Sample | Coating Material | Material No. | Dy (wt %) | Tb (wt %) | Dy (wt %) | Tb (wt %) | Dy (wt %) | Br (kG) | HcJ (kOe) |
| E1-10 | P7 | M1 | 0.00 | 0.20 | 0.00 | 0.20 | 0.00 | 13.9 (13.9) | 22.3 (14.7) |
| E1-11 | P7 | M1 | 0.00 | 0.30 | 0.00 | 0.30 | 0.00 | 13.8 (13.9) | 23.1 (14.7) |
| E1-12 | P7 | M1 | 0.00 | 0.48 | 0.00 | 0.48 | 0.00 | 13.6 (13.9) | 24.7 (14.7) |
| E1-13 | P7 | M1 | 0.00 | 0.70 | 0.00 | 0.70 | 0.00 | 13.6 (13.9) | 25.4 (14.7) |
| E1-14 | P7 | M5 | 2.43 | 0.27 | 0.00 | 0.27 | 2.43 | 13.5 (13.6) | 26.7 (18.1) |
| E1-15 | P7 | M5 | 2.43 | 0.34 | 0.00 | 0.34 | 2.43 | 13.4 (13.6) | 28.3 (18.1) |
| E1-16 | P7 | M5 | 2.43 | 0.45 | 0.00 | 0.45 | 2.43 | 13.5 (13.6) | 29.1 (18.1) |
| C1-1 | CP1 | M5 | 2.43 | 1.15 | 0.00 | 1.15 | 2.43 | 13.2 (13.6) | 29.7 (18.1) |
| C1-2 | CP2 | M1 | 0.00 | 1.13 | 0.00 | 1.13 | 0.00 | 13.7 (13.9) | 24.6 (14.7) |

Br = residual magnetic flux density,
HcJ = coercivity

A comparison of samples E1-5 and E1-6 with sample C1-1 shows that the same combination of the coating material and base material was used for all of these samples, and their magnetic properties were almost equal. This means that all of the samples E1-5, E1-6, and C1-1 contained an almost equal amount of Tb diffused within the base material (the aforementioned amount (i)). However, E1-5 and E1-6 had lower Tb contents than C1-1 (in both the value originating from the coating material and the total value). These data mean that the proportion of Tb diffused into the base material to the amount of Tb originally contained in the coating material in E1-5 and E1-6 was higher than in C1-1. Accordingly, it is possible to consider that, in the present example (E1-5 and E1-6), Tb could be more efficiently, and less wastefully, diffused into the base material than in the comparative example (C1-1).

Figure 4:
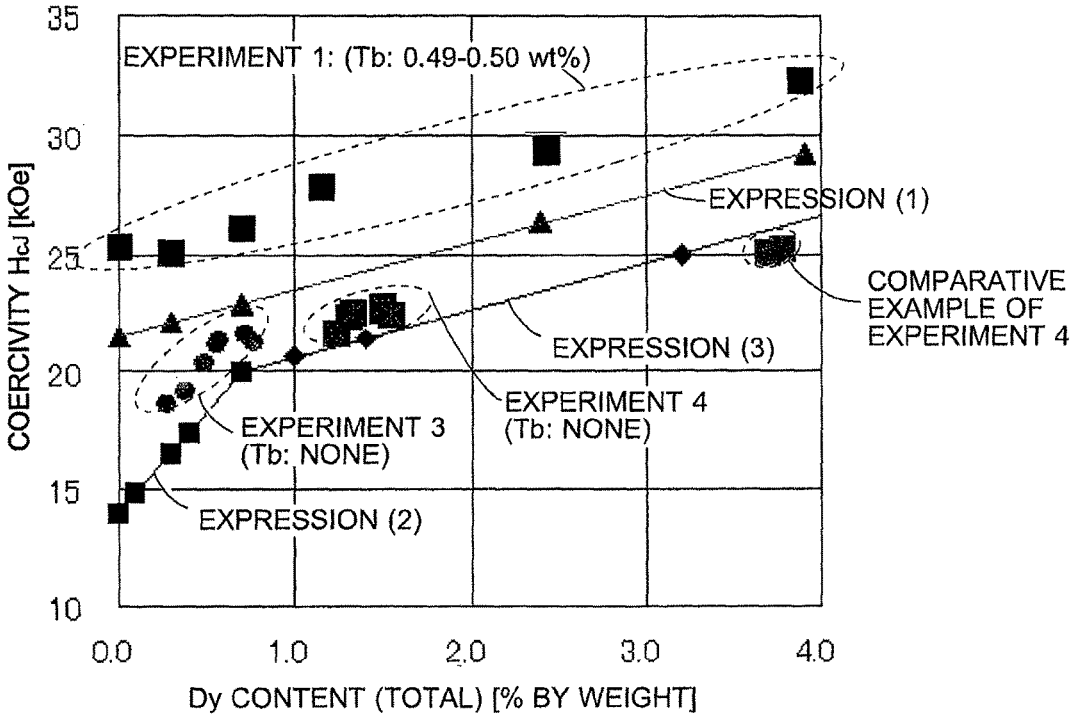
FIG. 4 is a graph showing a relationship between Dy content and coercivity measured in Experiments 1, 3 and 4.

FIG. 4 graphically shows a relationship between Dy content (total value) and coercivity for samples E1-1 through E1-5 and E1-7 whose differences in Tb content were not greater than 0.01 (from 0.49 to 0.50% by weight). Any of the experimental data satisfy the relationship of the aforementioned expression (1).

Experiment 2

By a method similar to Experiment 1, the coating material P7 was applied to the base materials M1 and M5, and a grain boundary diffusion treatment was performed. In Experiment 2, a greater amount of coating material was applied than in Experiment 1 so that a higher amount of Tb would be contained in the eventually obtained samples (it should be noted that the amount of Tb in the applied coating material was not directly measured). The obtained experimental result is shown in Table 4.

TABLE 4

| Experimental Condition and Result of Experiment 2 | | | | | | | | | |
|---|---|---|---|---|---|---|---|---|---|
| | | Base Material (Tb Not Contained) | | From Coating Material | | Total | | Magnetic Properties | |
| Sample | Coating Material | Material No. | Dy (wt %) | Tb (wt %) | Dy (wt %) | Tb (wt %) | Dy (wt %) | Br (kG) | HcJ (kOe) |
| E2-1 | P7 | M1 | 0.00 | 1.07 | 0.00 | 1.07 | 0.00 | 13.5 (13.9) | 25.0 (14.7) |
| E2-2 | P7 | M1 | 0.00 | 1.83 | 0.00 | 1.83 | 0.00 | 13.1 (13.9) | 25.5 (14.7) |
| E2-3 | P7 | M1 | 0.00 | 3.20 | 0.00 | 3.20 | 0.00 | 12.9 (13.9) | 25.5 (14.7) |

TABLE 4-continued

| Experimental Condition and Result of Experiment 2 | | | | | | | | | |
|---|---|---|---|---|---|---|---|---|---|
| | | Base Material (Tb Not Contained) | | From Coating Material | | Total | | Magnetic Properties | |
| Sample | Coating Material | Material No. | Dy (wt %) | Tb (wt %) | Dy (wt %) | Tb (wt %) | Dy (wt %) | Br (kG) | HcJ (kOe) |
| E2-4 | P7 | M5 | 2.43 | 0.92 | 0.00 | 0.92 | 2.43 | 13.2 (13.6) | 29.7 (18.1) |
| E2-5 | P7 | M5 | 2.43 | 1.13 | 0.00 | 1.13 | 2.43 | 13.0 (13.6) | 30.7 (18.1) |
| E2-6 | P7 | M5 | 2.43 | 1.90 | 0.00 | 1.90 | 2.43 | 12.8 (13.6) | 29.6 (18.1) |

Br = residual magnetic flux density,
HcJ = coercivity

Figure 5A:
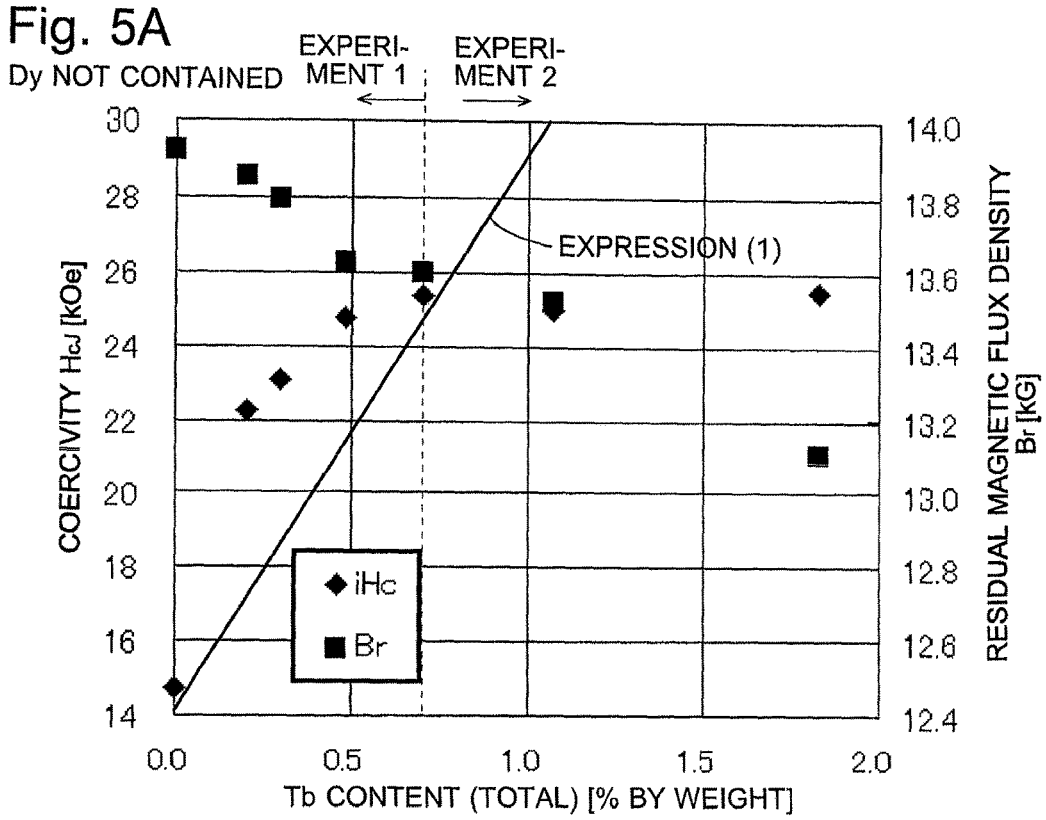
FIGS. 5A and 5B are graphs showing a relationship between Tb content and coercivity measured in Experiments 1 and 2.
Figure 5B:
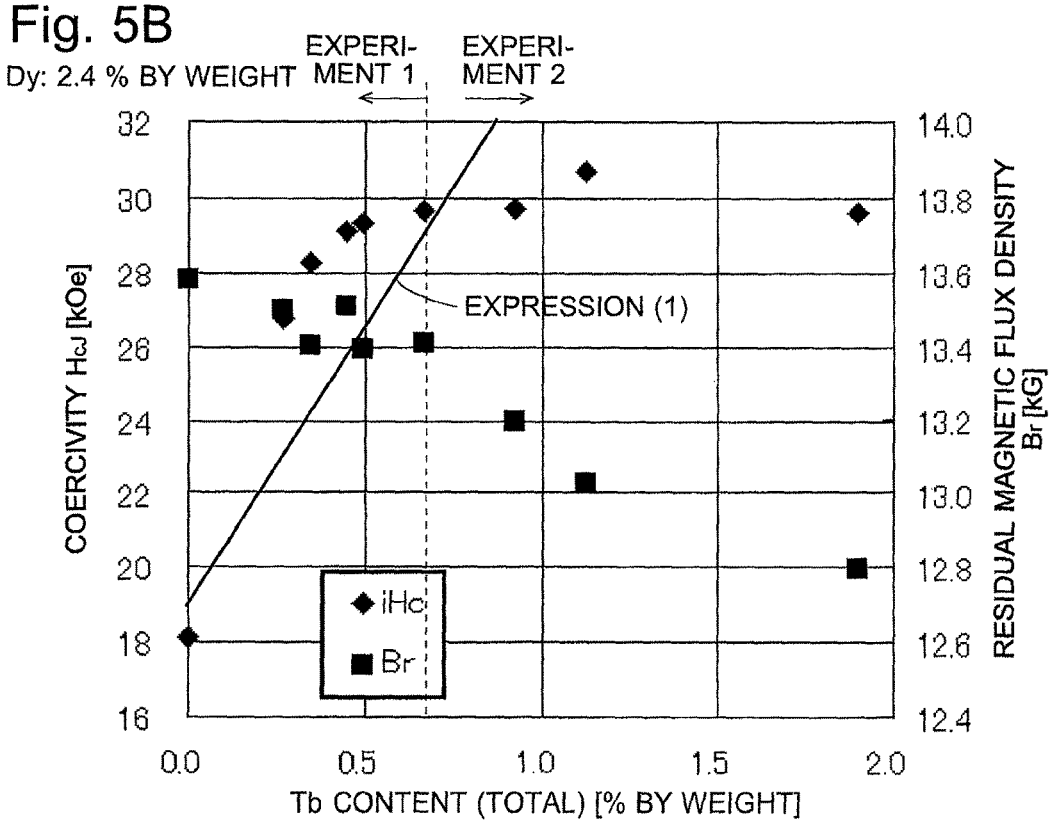
Figure 6:
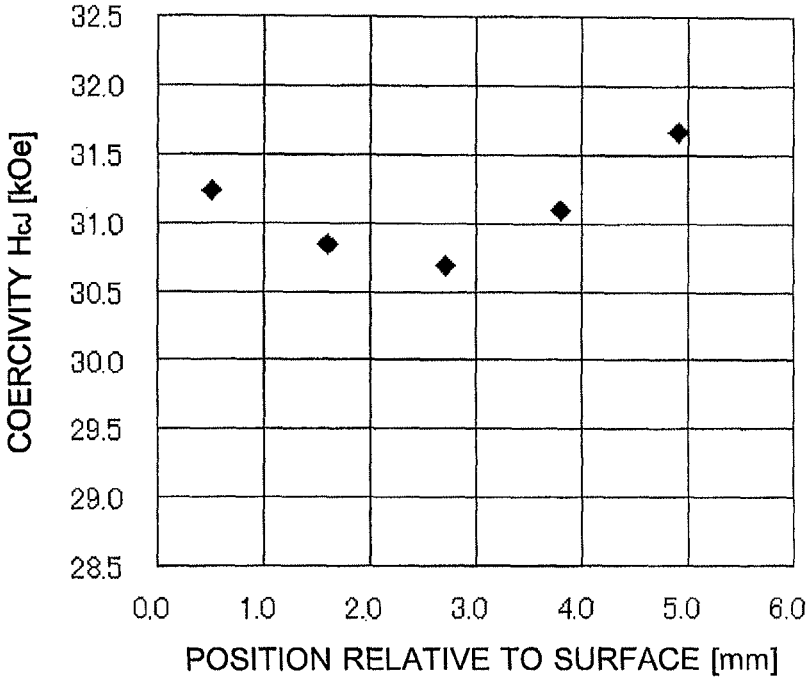
FIG. 6 is a graph showing a relationship between the position relative to a magnet surface and the coercivity measured in Experiment 5.

FIG. 5A graphically shows a relationship among the Tb content (total value), coercivity and residual magnetic flux density of the samples which did not contain Dy (E1-1, E1-10 through E1-13, E2-1 and E2-2) in Experiments 1 and 2. Similarly, FIG. 5B graphically shows a relationship of those properties of the samples which contained 2.43% by weight of Dy (E1-5, E1-6, E1-14 through E1-16, and E2-4 through E2-6) in Experiments 1 and 2. All the samples in Experiment 1 have a Tb content of 0.7% by weight or less, and their coercivity satisfies the condition of expression (1). By contrast, all the samples in Experiment 2 have a Tb content greater than 0.7% by weight, and their coercivity does not satisfy the condition of expression (1). FIGS. 5A and 5B also demonstrate that the residual magnetic flux density decreases as the Tb content increases, and furthermore, the coercivity approximately becomes saturated when the Tb content exceeds 0.7% by weight. These experimental results suggest that the Tb content should preferably be 0.7% by weight or less.

Experiment 3

Next, an experiment using the coating material P8 which did not contain Tb but contained Dy was performed. In this experiment, by a method similar to Experiment 1, the coating material P8 was applied to the base material M1 and a grain boundary diffusion treatment was performed. The obtained result is shown in Table 5 and the aforementioned graph in FIG. 4. The graph in FIG. 4 demonstrates that all the obtained samples satisfy the relationship of the aforementioned expression (2).

TABLE 5

| Experimental Condition and Result of Experiment 3 | | | | | | | | | |
|---|---|---|---|---|---|---|---|---|---|
| | | Base Material (Tb Not Contained) | | From Coating Material | | Total | | Magnetic Properties | |
| Sample | Coating Material | Material No. | Dy (wt %) | Tb (wt %) | Dy (wt %) | Tb (wt %) | Dy (wt %) | Br (kG) | HcJ (kOe) |
| E3-1 | P8 | M1 | 0.00 | 0.00 | 0.27 | 0.00 | 0.27 | 13.8 (13.9) | 18.6 (14.7) |
| E3-2 | P8 | M1 | 0.00 | 0.00 | 0.38 | 0.00 | 0.38 | 13.8 (13.9) | 19.2 (14.7) |
| E3-3 | P8 | M1 | 0.00 | 0.00 | 0.49 | 0.00 | 0.49 | 13.7 (13.9) | 20.4 (14.7) |
| E3-4 | P8 | M1 | 0.00 | 0.00 | 0.56 | 0.00 | 0.56 | 13.7 (13.9) | 21.1 (14.7) |
| E3-5 | P8 | M1 | 0.00 | 0.00 | 0.58 | 0.00 | 0.58 | 13.7 (13.9) | 21.3 (14.7) |
| E3-6 | P8 | M1 | 0.00 | 0.00 | 0.73 | 0.00 | 0.73 | 13.6 (13.9) | 21.6 (14.7) |
| E3-7 | P8 | M1 | 0.00 | 0.00 | 0.77 | 0.00 | 0.77 | 13.5 (13.9) | 21.2 (14.7) |

Br = residual magnetic flux density,
HcJ = coercivity

Experiment 4

Next, an experiment similar to Experiment 3 was performed using the base material M3 which contained a certain amount of Dy, so that the amount of Dy (total value) contained in the obtained samples would be higher than in Experiment 3. The result of the experiment is shown in Table 6 and the aforementioned graph in FIG. 4. The graph in FIG. 4 demonstrates that none of the samples as the comparative example (C4-1 and C4-2) satisfies the relationship of the aforementioned expression (3), while all the samples of the present example satisfy the relationship of expression (3). Though not shown in FIG. 4, the sample C4-3 does not satisfy the relationship of expression (3), either.

TABLE 6

Experimental Condition and Result of Experiment 4

| | | Base Material (Tb Not Contained) | | From Coating Material | | Total | | Magnetic Properties | |
|---|---|---|---|---|---|---|---|---|---|
| Sample | Coating Material | Material No. | Dy (wt %) | Tb (wt %) | Dy (wt %) | Tb (wt %) | Dy (wt %) | Br (kG) | HcJ (kOe) |
| E4-1 | P8 | M3 | 0.70 | 0.00 | 0.61 | 0.00 | 1.31 | 13.9 (14.1) | 22.4 (15.9) |
| E4-2 | P8 | M3 | 0.70 | 0.00 | 0.53 | 0.00 | 1.23 | 13.9 (14.1) | 21.6 (15.9) |
| E4-3 | P8 | M3 | 0.70 | 0.00 | 0.63 | 0.00 | 1.33 | 13.9 (14.1) | 22.6 (15.9) |
| E4-4 | P8 | M3 | 0.70 | 0.00 | 0.80 | 0.00 | 1.50 | 13.7 (14.1) | 22.6 (15.9) |
| E4-5 | P8 | M3 | 0.70 | 0.00 | 0.79 | 0.00 | 1.49 | 13.7 (14.1) | 22.8 (15.9) |
| E4-6 | P8 | M3 | 0.70 | 0.00 | 0.84 | 0.00 | 1.54 | 13.7 (14.1) | 22.5 (15.9) |
| C4-1 | CP3 | M5 | 2.43 | 0.00 | 1.26 | 0.00 | 3.69 | 13.3 (13.6) | 25.1 (18.1) |
| C4-2 | CP3 | M5 | 2.43 | 0.00 | 1.34 | 0.00 | 3.77 | 13.2 (13.6) | 25.2 (18.1) |
| C4-3 | CP4 | M10 | 2.48 | 0.00 | 3.07 | 0.00 | 5.55 | 12.90 | 27.80 |

Br = residual magnetic flux density,
HcJ = coercivity

Experiment 5

The base material M9 was machined into a 17-mm square shape with a thickness of 5.5 mm. After the coating material P7 was applied to both faces, a grain boundary diffusion treatment was performed by heating it at 900° C. for 10 hours. From the obtained sample, 1-mm square flakes were cut out at five different positions in the thickness direction relative to one face, and their coercivity was measured with a pulsed high field magnetometer. The Tb and Dy contents (total value) of the sample remaining after the flakes were cut out were measured by a method similar to Experiment 1. The Tb content was 0.47% by weight, and the Dy content was 3.90% by weight. The relationship between the position in the thickness direction and the coercivity is graphically shown in FIG. 6. Although the coercivity at the positions near the center of the thickness direction was slightly lower than at the positions closer to the upper and lower faces, the obtained values, 30.7 to 31.7 kOe, were higher than that of the bare base material M9 (22.4 kOe) over the entire thickness direction. This result demonstrates that, in the present example, the Tb contained in the coating material was indeed diffused into central regions in the thickness direction of the base material by the grain boundary diffusion treatment.

The present invention is not limited to the previously described examples.

For example, in the previous examples, each coating material contained either the combination of 10% silicone grease and 10% silicone oil by weight, or only 20% silicone grease by weight (with 0% silicone oil). The percentages of those components are not limited to these values. Specifically, the contents of the silicone grease and silicone oil can be appropriately set as long as the resultant viscosity of the coating material roughly falls within a range from 0.1 to 100 Pa·s, since this range ensures that the coating material will not flow off the surface of the base material M and the screen-printing operation can be performed at least one time without causing the clogging of the screen.

Although methyl myristate or methyl laurate was used as the dispersant in the previous examples, other kinds of dispersant may also be used, such as methyl caprylate. The $R^H$-containing powder does not need to be made from Tb—Ni—Al alloy as in the previous examples, but may be any kind of powder as long as it contains $R^H$.

REFERENCE SIGNS LIST

10 . . . Coating Material
11 . . . Silicone Grease
12 . . . Silicone Oil
13 . . . Dispersant
14 . . . $R^H$-Containing Powder
20 . . . Applicator
20A . . . Work Loader
20B . . . Print Head
21 . . . Base
22 . . . Lift
23 . . . Frame
24 . . . Tray
241 . . . Hole of Tray
242 . . . Supporting Portion
243 . . . Positioning Pin
25 . . . Supporter
26 . . . Magnetic Clamp

27 . . . Screen
271 . . . Permeable Area
28A . . . Squeegee
28B . . . Back Scraper

The invention claimed is:

1. An RFeB system magnet production method for producing an $R^L{}_2Fe_{14}B$ system magnet which is a sintered magnet or a hot-deformed magnet containing, as a main rare-earth element, a light rare-earth element $R^L$ which is at least one of two elements of Nd and Pr, the method comprising steps of:

applying, to a surface of a base material of the $R^L{}_2Fe_{14}B$ system magnet, a coating material prepared by mixing a silicone grease and an $R^H$-containing powder containing a heavy rare-earth element $R^H$ composed of at least one element selected from a group of Dy, Tb and Ho; and heating the base material together with the coating material, wherein: the RFeB system magnet has a thickness of 5.5 mm or less; Tb content at a position in the RFeB system magnet is higher as the position is closer to a surface of the RFeB system magnet; and a difference between the maximum and the minimum in a coercivity at positions in the RFeB system magnet is 1 kOe or less.

2. The RFeB system magnet production method according to claim 1, wherein a dispersant for enhancing dispersibility of the $R^H$-containing powder is added to the coating material.

3. The RFeB system magnet production method according to claim 2, wherein the dispersant contains fatty ester as a main component.

4. The RFeB system magnet production method according to claim 3, wherein the dispersant contains at least one of following compounds as the main component: methyl caprylate, methyl caprate, methyl laurate, methyl myristate, ethyl caprylate, ethyl caprate, ethyl laurate, and ethyl myristate.

5. The RFeB system magnet production method according to claim 1, wherein a silicone oil having a lower viscosity than the silicone grease is added to the coating material.

6. The RFeB system magnet production method according to claim 1, wherein the $R^H$-containing powder is a powder of $R^H$—Ni—Al alloy.

7. The RFeB system magnet production method according to claim 1, wherein a screen having a permeable area for allowing the coating material to pass through is brought into contact with the surface of the base material and the coating material is applied through the permeable area to the surface of the base material.

8. An RFeB system magnet having a main phase made of $R_2Fe_{14}B$ containing a rare-earth R, iron Fe and boron B, satisfying a following relationship:

$$0<x_1\leq 0.5,\ 0\leq x_2,\ \text{and}$$

$$H_{cJ}\geq 20.8\times x_1+2\times x_2+14.7 \quad (1)$$

where $x_1$ and $x_2$ respectively represent weight percentages of Tb and Dy, and $H_{cJ}$ represents coercivity in kOe at room temperature, wherein:

the RFeB system magnet has a thickness of 5.5 mm or less;

Tb content at a position in the RFeB system magnet is higher as the position is closer to a surface of the RFeB system magnet; and a difference between the maximum and the minimum in a coercivity at positions in the RFeB system magnet is 1 kOe or less.

9. An RFeB system magnet having a main phase made of $R_2Fe_{14}B$ containing a rare-earth R, iron Fe and boron B, satisfying a following relationship:

when $0<x_2\leq 0.7$ $$H_{cJ}\geq 8.6\times x_2+14 \quad (2)$$

and when $0.7<x_2$ $$H_{cJ}\geq 2\times x_2+18.6 \quad (3)$$

where $x_2$ represents a weight percentage of Dy, and $H_{cJ}$ represents coercivity in kOe at room temperature, wherein: the RFeB system magnet has a thickness of 5.5 mm or less; Tb content at a position in the RFeB system magnet is higher as the position is closer to a surface of the RFeB system magnet; and a difference between the maximum and the minimum in a coercivity at positions in the RFeB system magnet is 1 kOe or less.

* * * * *